US006158993A

United States Patent [19]

Friedrichsen et al.

[11] Patent Number: 6,158,993

[45] Date of Patent: Dec. 12, 2000

[54] HYDRAULIC MOTOR

[75] Inventors: Welm Friedrichsen, Nordborg; Tom Tychsen, Gråsten; Richard Thomas Entwistle, Sydals; Anders Bladt, Sønderborg; Ib Damgaard, Nordborg; Børge Duus, Sønderborg, all of Denmark

[73] Assignee: Danfoss Fluid Power A/S, Nordborg, Germany

[21] Appl. No.: 09/161,009

[22] Filed: Sep. 25, 1998

[30] Foreign Application Priority Data

Oct. 11, 1997 [DE] Germany ..... 197 45 010

[51] Int. Cl.[7] ..... F04C 18/00

[52] U.S. Cl. ..... 418/61.3; 418/171; 418/206.1

[58] Field of Search ..... 418/61.3, 171, 418/206.1

[56] References Cited

U.S. PATENT DOCUMENTS

| | | | |
|---|---|---|---|
| 3,627,454 | 12/1971 | Golf | 418/61 |
| 3,953,158 | 4/1976 | Uppal | 418/61 |
| 4,232,708 | 11/1980 | Miller | 418/61.3 |
| 4,457,677 | 7/1984 | Todd | 418/61.3 |
| 4,575,321 | 3/1986 | Peterson et al. | 418/61.3 |
| 4,631,010 | 12/1986 | Peterson et al. | 418/61.3 |
| 5,071,327 | 12/1991 | Brewer | 418/61.3 |
| 5,328,343 | 7/1994 | Bernstrom et al. | 418/61.3 |
| 5,593,296 | 1/1997 | Bernstrom et al. | 418/61.3 |
| 5,624,248 | 4/1997 | Kassen et al. | 418/61.3 |
| 5,662,462 | 9/1997 | Paley et al. | 418/61.3 |

*Primary Examiner*—Thomas Denion
*Assistant Examiner*—Theresa Trieu
*Attorney, Agent, or Firm*—Lee, Mann, Smith, McWilliams, Sweeney & Ohlson

[57] ABSTRACT

The invention concerns a hydraulic motor (1) having at least one gearwheel set section (2), a supply section (3) and a front section (4) on which an output arrangement (15) can be fixed, the sections (2 to 4) being connected with each other in the axial direction by fixing bolts (11).

It is desired to simplify the production and the service during operation for such a motor.

For this purpose several bores (17) are provided, which penetrate the motor (1,) from one axial end (21) to the other, in which connection bolts (6) are arranged, which are provided with an engagement area (18) on the side of the front section (4).

13 Claims, 3 Drawing Sheets

HYDRAULIC MOTOR

BACKGROUND OF THE INVENTION

The invention concerns a hydraulic motor having at least one gearwheel set section, a supply section and a front section on which an output arrangement can be fixed, the sections being connected with each other in the axial direction by fixing bolts.

Such a motor is known from EP 0 587 010 B1.

Such motors are often sold in a so-called "short" version. This embodiment has no immediately applicable output shaft. At most, a Cardan shaft, which is normal for such motors, the so-called "dog bone", projects from the front section. An output section can then be flanged onto the front section, which output section is, for example, made as a gear or a normal output shaft. Such an embodiment makes the motor more flexible, that is, it is suited for a larger variety of applications.

However, this flexibility still involves relatively high production and mounting expenses. Thus, the embodiment according to EP 0 587 010 B1 requires a fixing flange, which projects radially from the motor in four corners. In these four corners bores are provided, through which bolts can be mounted for fixing the output arrangement on the front section. Firstly, this increases the external diameter of the motor. The production of the motor becomes expensive. Projections occur, which could be disturbing. Secondly, the mounting is also complicated. The mounter must be able to reach around the whole motor to get to all bolts. It is possible to use a tool for the screwing in. However, the movement possibilities of the tool are limited. As these motors must now and then be dismounted for servicing purposes, this will increase the servicing efforts.

SUMMARY OF THE INVENTION

It is the task of the invention to simplify the production and servicing of a motor.

With a motor as described in the introduction, this task is solved in that several bores are provided, which penetrate the motor from one axial end to the other, in which connection bolts are arranged, which are provided with an engagement area on the side of the front section.

Now the connection bolts can be reached from the axial end of the motor lying opposite the front section. Accordingly, it is sufficient when during mounting this axial end is accessible. Of course, it will be easier to mount other components closer to the circumference of the motor than it was before. The external diameter of the motor is not increased by the additionally provided bores. In most cases, the bores are also easier to make than projections, in which bores must then be made. Additionally, the connection bolts can also be used for clamping the individual sections of the motor together in the axial direction. Thus, fewer bolts as usual can be used, as the fixing bolts are only required to keep the motor together during transport and mounting. Before operating the motor, an additional axial connection is created by the connection bolts. This also contributes to reducing the production costs and simplifying the servicing of the motor. When dismounting the motor from the output arrangement, the disassembly has already started, even though the motor can still be handled as one unit.

Advantageously, the connection bolts project from the front section. This facilitates the mounting of the motor on the output arrangement or vice versa. However, this embodiment only means that the connection bolts have a larger axial length than the motor. Thus, the connection bolts with their engagement area can also be pushed back into the motor, which again facilitates the mounting.

Preferably, the connection bolts extend substantially in the axial direction. When flanging the motor onto the output arrangement tensions, which could be provoked by the connection bolts, will only occur in the axial direction, not in the radial direction.

Preferably, the connection bolts are held captive in the bores. This also facilitates mounting. Regardless of the orientation of the motor the connection bolts cannot fall out of the bores.

Advantageously, the bores are arranged on a circle. Particularly when the bores have regular distances in the circumferential direction the motor can be mounted on the output arrangement in a large variety of rotation positions. This increases the flexibility of the application.

Advantageously, the bores are arranged on the same circle as the fixing bolts. Thus, mounting will create the same power conditions in the motor than with fixing bolts. Accordingly, the connection bolts can immediately take over the task of fixing bolts for the operation of the motor on the output arrangement.

In a preferred embodiment it is provided that the fixing bolts and the connection bolts are inserted in the motor from different sides. This avoids the risk that when flanging the motor off from the output arrangement the motor is accidentally disassembled when the fixing bolts are loosened. The fixing bolts will be inaccessible for as long as the motor is fixed on the output arrangement.

In an alternative embodiment the fixing bolts and the connection bolts are inserted in the motor from the same axial end. This reduces production expenses.

In this connection it is particularly preferred that the fixing bolts and the connection bolts have different bolt heads. The mounter can then immediately see, which bolts must be loosened to remove the motor from the output arrangement and which bolts must remain in the motor to avoid a disassembling on the spot.

In a preferred embodiment this is realised in that the fixing bolts and the connection bolts have different torque working geometries. For example, the fixing bolts can be provided with a hexagon socket-head, whereas the connection bolts have an external hexagon profile (or vice versa). This means that for turning the two different bolt types, different tools will be required. The risk that the wrong bolts are loosened accidentally is thus drastically reduced.

Preferably, the number of bores is at least twice the number of fixing bolts. Accordingly, the number of connection bolts is also twice the number of fixing bolts. This involves two advantages. Firstly, the mounter can see alone from the numbers of the different bolt types, which bolts are the fixing bolts and which are the connection bolts. Secondly, such an embodiment causes that in fact only a small number of fixing bolts is required to keep the motor together during transport and mounting. The real axial clamping together of the individual sections of the motor is then effected with the assistance of the connection bolts. With this embodiment the motor can be operated with relatively high pressures.

Preferably, the axial ends have no hydraulic connections. In the axial end which is formed by the front section, this can immediately be seen. When also the other axial end is free of hydraulic connections, the access to the connection bolts is not limited by hydraulic connections. Thus, the mounting becomes relatively simple, as the tools are not obstructed by hydraulic connections.

Preferably, the sum of the number of fixing bolts and the number of connection bolts is equal to the number of working chambers of the gearwheel set. Thus, it is possible to allocate a bolt to each working chamber, which are formed by the tooth spaces in the tooth ring during the cooperation of an internally toothed tooth ring and an externally toothed gearwheel. Thus, the bolts can act where the largest hydraulic forces appear.

It is also an advantage that at least one bore and/or at least one connection bolt form a leakage channel. In hydraulic motors a leakage connection is usually always available. Through this leakage connection hydraulic fluid is drained away before it can lead to undesired pressure increases. As the motor according to the invention provides through bores and through-connection bolts, these already available construction elements can be utilised for a reliable draining away of hydraulic fluid caused by leakage from all areas in the axial direction. The production of such a leakage channel is relatively simple. For example one or more bores with slightly increased diameter can be produced. A bolt with connection for a leakage fitting can also be used. Such a bolt would also only require slight modifications, for example an axially extending groove.

BRIEF DESCRIPTION OF THE DRAWINGS

In the following the invention is explained on the basis of embodiment examples in connection with the drawings, showing.

DESCRIPTION OF THE PREFERRED EMBODIMENTS

Figure 1:
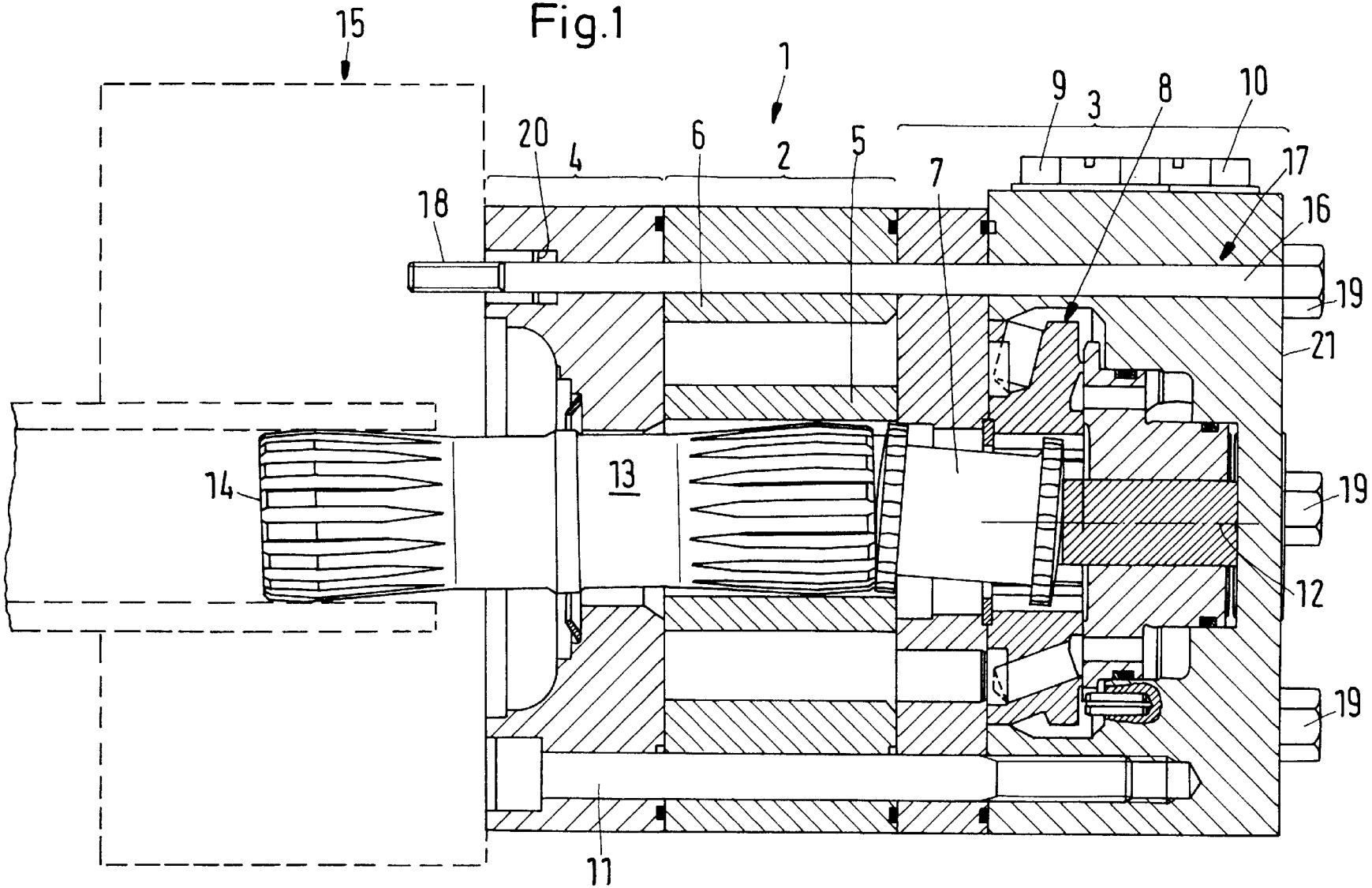
FIG. 1 a first embodiment.

A hydraulic motor 1 has a gearwheel set section 2, a supply section 3 and a front section 4. Further sections can be provided. The gearwheel set section has in the present case an externally toothed gearwheel 5 with eight teeth and an internally toothed gear ring 6 with nine teeth, the gearwheel 5 rotating and orbiting in a known way inside the gear ring 6 during operation. Via a shaft 7 the rotational movement is transferred to a schematically shown valve arrangement 8, which, in the correct position, provides the pressure pockets formed between the teeth of the gearwheel 5 and the gear ring 6 with hydraulic fluid under pressure. The hydraulic fluid is led in or out, respectively, through the connections 9, 10.

The individual sections 2 to 4 are kept together in the axial direction by fixing bolts 11. In the present case, three fixing bolts are provided, which are arranged at regular distances on a circle around the centre of the motor 1.

The rotational movement of the gearwheel 5 is transferred to the outside through a Cardan shaft 13, which is often called a "dog bone" due to its shape. The end 14 projecting from the motor of the Cardan shaft 13 is rotating. However, in many cases such a motor cannot be directly used. Still though, motors comprising the parts described until now are sold, namely as so-called "short" versions. When operating, such a motor 1 is connected with an output arrangement 15, shown with dashed lines. The output arrangement 15 can be a normal output shaft or a gear with output shaft.

For fixing the output arrangement 15 the motor 1 has several connection bolts 16 arranged in axial through-bores 17. The connection bolts 16 penetrate the motor 1 completely, that is, they project with their thread 18 from the front section 4 and can accordingly be screwed into the output arrangement 15. During mounting the connection bolts 16 can, however, be pushed somewhat into the motor 1. In this case the head 19 of the connection bolt 16 projects even more from the axial end of the supply section.

By means of a schematically shown retaining arrangement 20, for example a resilient ring, the connection bolts 16 are held captive in the motor 1. Also when the motor 1 must, for example, be mounted upside down, the connection bolts 16 will not fall out from the motor.

The number of connection bolts 16, namely six, is at least twice the number of fixing bolts (three). Accordingly, the fixing bolts 11 initially serve the purpose of keeping the motor 1 together during transport and mounting. They also permit operation at a certain pressure, so that for example the motor, or at least certain functions, can be tested before mounting all bolts. During operation the motor 1 will be even tighter assembled when mounted on the output arrangement 15 by means of the connection bolts 16. Thus, the operational pressure of the motor can be increased without requiring additional fixing bolts 11. The total number of connection and fixing bolts, namely nine, thus corresponds to the number of tooth spaces in the gear ring 6 and thus to the number of working chambers. Each bolt can be allocated a working chamber, and it can be arranged as close as possible to the spot acted upon by the largest hydraulic forces.

The bores 17 are arranged on the same circle as the fixing bolts 11. They are also made at regular distances, so that in relation to the output arrangement 15 the motor 1 can be mounted in a large variety of rotational positions.

The axial end of the supply section 3 is free of hydraulic connections. The hydraulic connections 9, 10 are arranged on the circumferential wall of the supply section 3. Accordingly, the axial end 21 of the supply section 3 is free to access by a tool, with which the head 19 of the connection bolt 16 can be turned. Due to the good accessibility of the heads 19, the mounting of the motor 1 on the output arrangement 15 can be made with relatively little effort.

As the connection bolts 16 are standard parts, the mounting opportunity of the motor 1 on the output arrangement 15 can be made with relatively little effort. Thus, the motor remains inexpensive.

In the embodiment according to FIG. 1 the fixing bolts 11 and the connection bolts 16 are inserted in the motor 1 from different axial ends. Accordingly, only the connection bolts 16 are accessible in the mounted state. Thus, there is no risk that the motor is disassembled by accident, when the wrong bolts are loosened.

Figure 2:
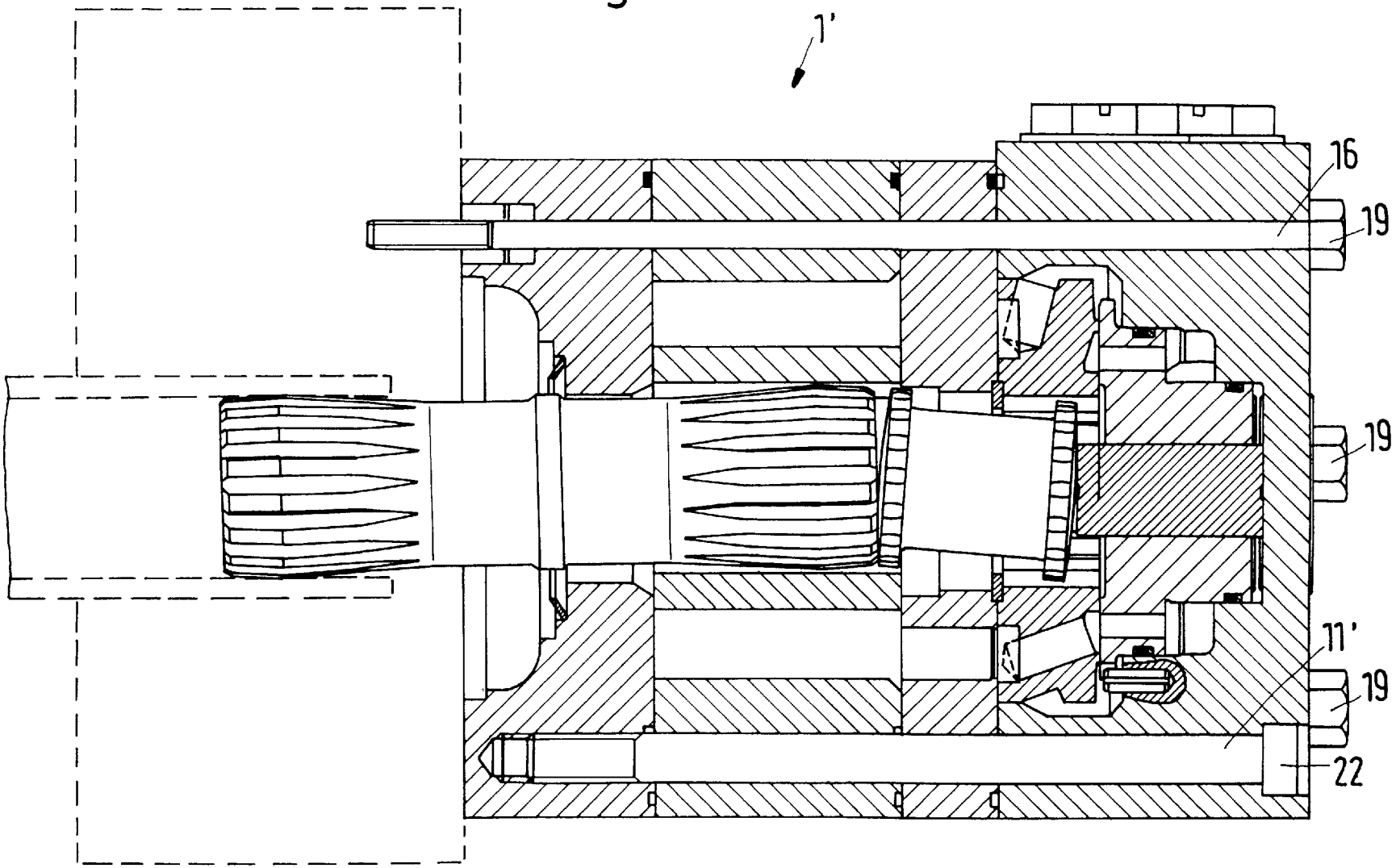
FIG. 2 a second embodiment of a motor shown schematically in section.
Figure 3:
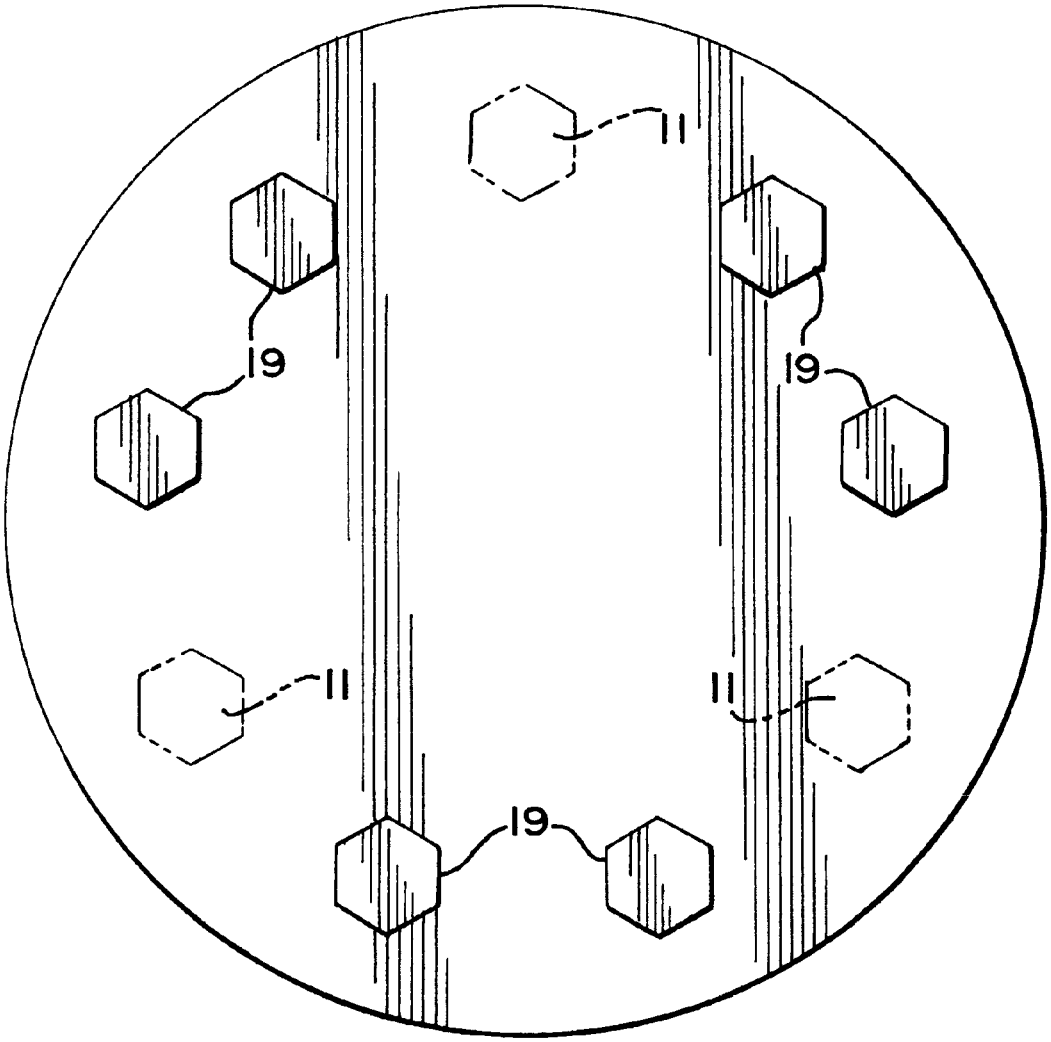
FIG. 3 a schematic view of the bolt arrangement from the right side of FIG. 1.

In the embodiment according to FIG. 2, which, by the way, corresponds to the embodiment in FIG. 1, the fixing bolts 11' are inserted in the motor 1' from the same axial side as the connection bolts 16. Therefore, the same parts have the same reference numbers, corresponding parts have marked reference numbers.

However, to provide a clear difference between fixing bolts 11' and connection bolts 16, the heads 19 of the connection bolts 16 have a different form than the heads 22 of the fixing bolts. For example, the heads 22 of the fixing bolts 11' have an internal hexagon socket as torque working surface, whereas the heads 19 of the connection bolts 16 have an external hexagon. Of course, other torque working surface geometries are also possible, for example such, which are sold under the names "Torx" and "Unbraco".

It is shown that the connection bolts 16 are provided with a thread 18 for fixing the output arrangement 15. Other engagement opportunities can also be imagined, for example a bayonet connection.

In a not shown way, one or more bores 17 can be used to drain leakage fluid off the motor. As a through-bore is concerned, the leakage fluid can also be drained off from all axial areas of the motor, before leading to undesired pressure increases. This is realised rather easily in that such a bore 17 is made with a slightly increased diameter. Of course, a connection bolt can also be made so that it forms a leakage channel, for example through an axially extending groove on its surface. Such a connection bolt can also be made as connection for a leakage fitting.

What is claimed is:

1. Hydraulic motor having at least one gearwheel set section, a supply section and a front section on which an output arrangement is selectively fixed thereon, the sections being connected with each other in an axial direction by fixing bolts, and including a series of through bores which penetrate the motor from one axial end to the other, a connection bolt being located in each through bore, each bolt having an engagement area outside of the front section.

2. Motor according to claim 1, in which the connection bolts project from the front section.

3. Motor according to claim 1, in which the connection bolts extend substantially in the axial direction.

4. Motor according to claim 1, including means for holding the connection bolts captive in the through bores.

5. Motor according to claim 1, in which the through bores are arranged on a circle.

6. Motor according to claim 5, in which the bores are arranged on the same circle as the fixing bolts.

7. Motor according to claim 1, in which the fixing bolts and the connection bolts are inserted in the motor from different sides.

8. Motor according to claim 1, in which the fixing bolts and the connection bolts are inserted in the motor from the same axial end.

9. Motor according to claim 8, in which the fixing bolts and the connection bolts have different bolt heads.

10. Motor according to claim 9, in which the fixing bolts and the connection bolts have different torque working geometries.

11. Motor according to claim 1, in which the number of bores is at least twice the number of fixing bolts.

12. Motor according to claim 1, in which the supply section has an axial end having no hydraulic connections.

13. Motor according to claim 1, in which the sum of the number of fixing bolts and the number of connection bolts is equal to the number of working chambers of the gearwheel set.

* * * * *